US005988995A

United States Patent [19]

Hong

[11] Patent Number: 5,988,995

[45] Date of Patent: Nov. 23, 1999

[54] HOUSINGS FOR MINIATURE FANS

[75] Inventor: Chen Fu-In Hong, Kaohsiung, Taiwan

[73] Assignee: Sunonwealth Electric Machine Industry Co., Ltd., Kaohsiung, Taiwan

[21] Appl. No.: 08/932,426

[22] Filed: Sep. 17, 1997

[51] Int. Cl.[6] ..... F04B 35/04

[52] U.S. Cl. ..... 417/423.14

[58] Field of Search ..... 417/423.14, 423.15

[56] References Cited

U.S. PATENT DOCUMENTS

| | | | |
|---|---|---|---|
| 2,594,688 | 4/1952 | Shapiro | 183/37 |
| 4,466,780 | 8/1984 | Naurath . | |
| 4,949,022 | 8/1990 | Lipman | 318/254 |
| 5,108,396 | 4/1992 | Lackey et al. . | |
| 5,255,866 | 10/1993 | Campolo . | |

FOREIGN PATENT DOCUMENTS

| | | |
|---|---|---|
| 0 589 793 | 3/1994 | European Pat. Off. . |
| 828108 | 2/1960 | United Kingdom . |
| 1086204 | 10/1967 | United Kingdom . |
| 1158326 | 7/1969 | United Kingdom . |
| 2 151 704 | 7/1985 | United Kingdom . |

*Primary Examiner*—Timothy S. Thorpe
*Assistant Examiner*—Ehud Gartenberg
*Attorney, Agent, or Firm*—Bacon & Thomas

[57] ABSTRACT

A miniature fan housing includes at least one slot defined in a side thereof, and at least one separation member is provided in the slot to thereby separate the slot into more than two smaller slots. Electric wires electrically connected between power source and a circuit board mounted in the miniature fan housing are extended through the smaller slots and have at least a turn to avoid disengagement of the electric wires from the circuit board when the electric wires are inadvertently pulled.

2 Claims, 3 Drawing Sheets

HOUSINGS FOR MINIATURE FANS

BACKGROUND OF THE INVENTION

1. Field of the Invention

The present invention relates to improved housings for miniature fans to avoid disengagement of electric wires when inadvertently pulled.

2. Description of the Related Art

Miniature fans are widely used on computers to cool the central processing units (CPUs). A miniature fan generally includes a circuit board to control rotation of a fan blade, and electric wires from a power source are electrically connected to the circuit board by soldering. Nevertheless, the soldering points are relatively small such that, after assembly, the electric wires may be disengaged from the circuit board or have a poor electrical connection when the electric wires are inadvertently pulled. The present invention is intended to provide improved housings which mitigate and/or obviate the above problems.

SUMMARY OF THE INVENTION

A miniature fan housing in accordance with the present invention comprises at least one slot means defined in a side thereof, and at least one separation member is provided in the slot means to thereby separate the slot means into more than two slots which are adapted to be extended by electric wires electrically connected between a power source and a circuit board mounted in the miniature fan housing, such that the electric wires extended through the slots have at least a turn to avoid disengagement of the electric wires from the circuit board when the electric wires are inadvertently pulled.

Other objects, advantages, and novel features of the invention will become more apparent from the following detailed description when taken in conjunction with the accompanying drawings.

BRIEF DESCRIPTION OF THE INVENTION

DESCRIPTION OF THE PREFERRED EMBODIMENTS

Figure 1:
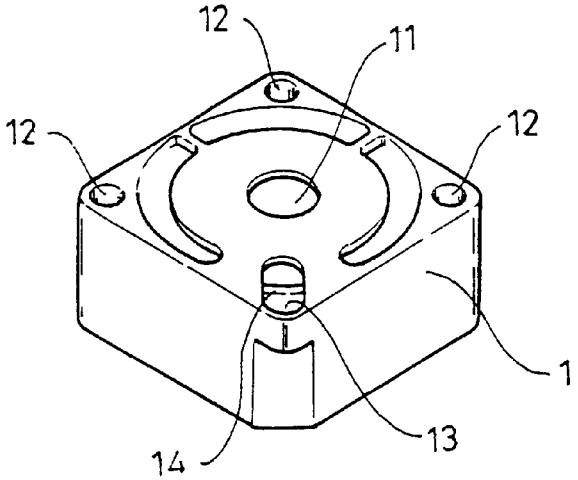
FIG. 1 is a perspective view of a first embodiment of a miniature fan housing in accordance with the present invention.
Figure 2:
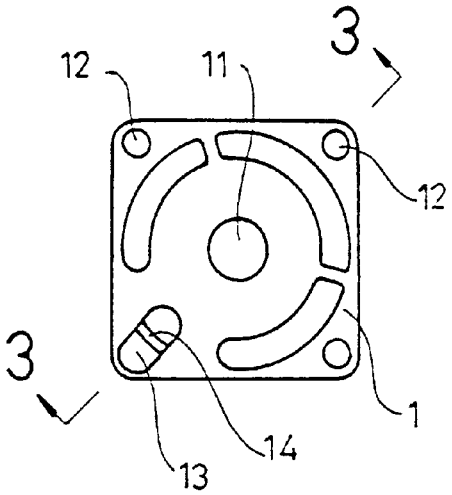
FIG. 2 is a top view of the housing in FIG. 1.
Figure 3:
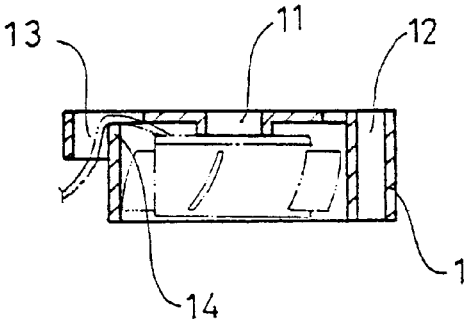
FIG. 3 is a sectional view taken along line 3—3 in FIG. 2.

Referring to the drawings and initially to FIGS. 1 to 3, a miniature fan housing in accordance with the present invention is designated by reference numeral "1" and generally includes a number of holes 12 defined in an upper side thereof through which bolts or screws (not shown) are extended for positioning. The housing 1 further includes a central hole 11 for assembling a circuit board and a fan blade (not labeled, see FIG. 3). The housing 1 further includes at least one slot means 13 defined in a side (e.g., the upper side) thereof, and at least one separation member 14 is provided in the slot means 13 to thereby separate the slot means 13 into two or more slots. Thus, the electric wires (not labeled, see FIG. 3) electrically connected between a power source (not shown) and the circuit board may pass through the slots and thus have at least a turn to avoid disengagement of the electric wires from the circuit board when the electric wires are inadvertently pulled.

Figure 4:
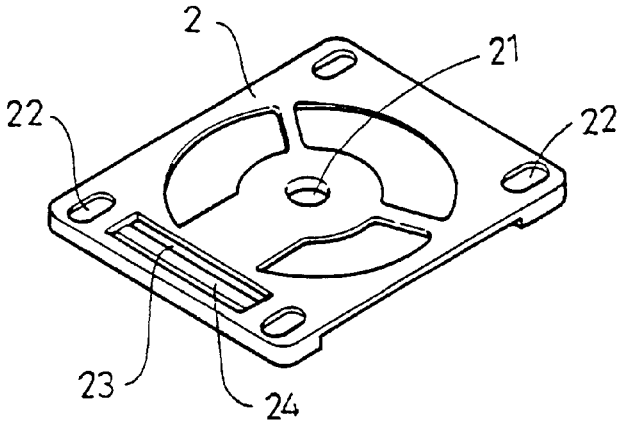
FIG. 4 is a perspective view of a second embodiment of a miniature fan housing in accordance with the present invention.
Figure 5:
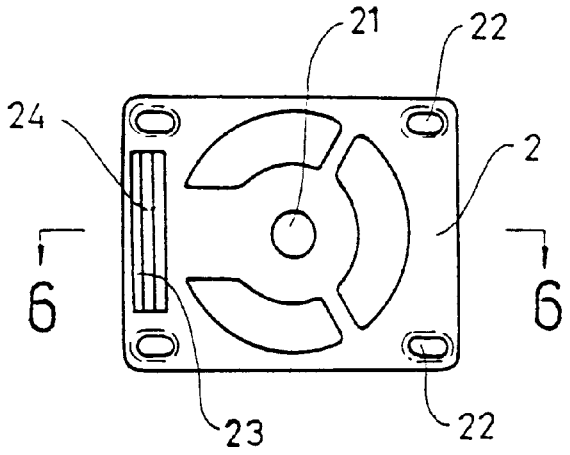
FIG. 5 is a top view of the housing in FIG. 4.
Figure 6:
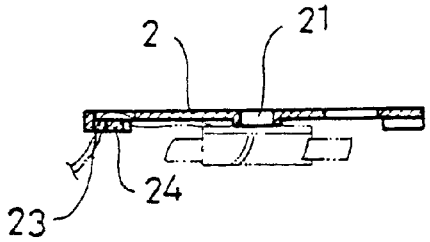
FIG. 6 is a sectional view taken along line 6—6 in FIG. 5.

FIGS. 4 to 6 illustrate a second embodiment of the invention, in which like elements are designated by like reference numerals except that the reference numerals are led by a reference character "2" instead of "1". In this embodiment, the slot means 23 is provided in a lateral end side of the housing 2 and is relatively long, and a separation member 24 is provided in the slot means 23 to separate the slot means 23 into two slots. In addition, the housing 2 is a plate-like member. Again, the electric wires (not labeled, see FIG. 6) electrically connected between the power source (not shown) and the circuit board may pass through the slots and thus have at least a turn to avoid disengagement of the electric wires from the circuit board when the electric wires are inadvertently pulled.

Figure 7:
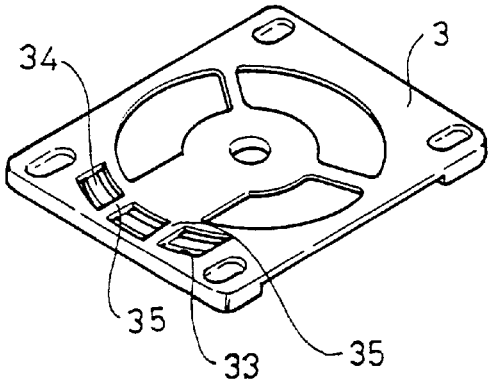
FIG. 7 is a perspective view of a third embodiment of a miniature fan housing in accordance with the present invention.
Figure 8:
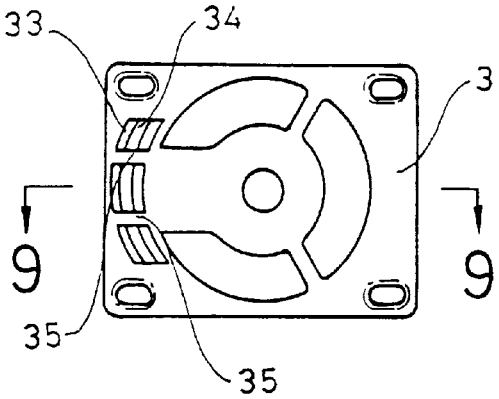
FIG. 8 is a top view of the housing in FIG. 7.
Figure 9:
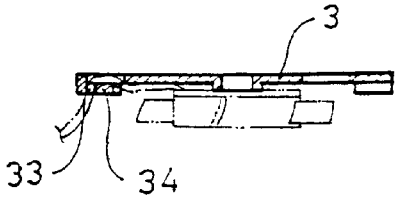
FIG. 9 is a sectional view taken along line 9—9 in FIG. 7.

FIGS. 7 to 9 illustrate a third embodiment of the invention, in which like elements are designated by like reference numerals except that the reference numerals are led by a reference character "3" instead of "1" or "2". In this embodiment, the slot means 33 includes three slots and each slot has a separation member 34 provided therein to separate the slot into two smaller slots. Again, the electric wires (not labeled, see FIG. 9) electrically connected between the power source (not shown) and the circuit board may pass through the small slots and thus have at least a turn to avoid disengagement of the electric wires from the circuit board when the electric wires are inadvertently pulled.

Although the invention has been explained in relation to its preferred embodiment, it is to be understood that many other possible modifications and variations can be made without departing from the spirit and scope of the invention as hereinafter claimed.

What is claimed is:

1. A miniature fan housing, comprising at least one slot means defined in a side thereof, and at least one separation member being provided in said at least one slot means to thereby separate the slot means into at least two slots which are adapted to be extended by electric wires electrically connected between a power source and a circuit board mounted in the miniature fan housing, such that the electric wires which extend through the slots have at least one turn.

2. The miniature fan housing according to claim 1, wherein the housing is a plate-like member.

* * * * *